US010934723B2

(12) United States Patent
Castellanos

(10) Patent No.: US 10,934,723 B2
(45) Date of Patent: Mar. 2, 2021

(54) TILE LAYING ACCESSORY

(71) Applicant: Invention Holdings Pty Ltd, West Burleigh (AU)

(72) Inventor: Peter Castellanos, West Burleigh (AU)

(73) Assignee: INVENTION HOLDINGS PTY LTD, West Burleigh (AU)

( * ) Notice: Subject to any disclaimer, the term of this patent is extended or adjusted under 35 U.S.C. 154(b) by 0 days.

(21) Appl. No.: 16/530,260

(22) Filed: Aug. 2, 2019

(65) Prior Publication Data

US 2020/0056381 A1 Feb. 20, 2020

(30) Foreign Application Priority Data

Aug. 14, 2018 (AU) ..... 2018902984
Sep. 7, 2018 (AU) ..... 2018903355

(51) Int. Cl.
*E04F 21/00* (2006.01)
*E04F 21/22* (2006.01)

(52) U.S. Cl.
CPC ..... *E04F 21/0092* (2013.01); *E04F 21/22* (2013.01)

(58) Field of Classification Search
CPC ... E04F 21/0092; E04F 21/22; E04F 21/1877; E04F 15/02022; E04F 13/0892
See application file for complete search history.

(56) References Cited

U.S. PATENT DOCUMENTS 9,970,203 B1 * 5/2018 Abidov ..... E04F 21/0092
2008/0236094 A1 * 10/2008 Doda ..... E04F 21/22 52/749.11
2013/0055675 A1 * 3/2013 Sighinolfi ..... E04F 15/02022 52/749.11
2014/0116001 A1 * 5/2014 Ghelfi ..... E04F 21/0092 52/749.11
2015/0308130 A1 * 10/2015 Biec ..... E04F 21/0092 52/749.11
2016/0090746 A1 * 3/2016 Sighinolfi ..... E04F 21/0092 33/526
2016/0186449 A1 * 6/2016 Lee ..... E04F 21/1877 33/527
2016/0222679 A1 * 8/2016 Bunch ..... E04F 21/1844
2019/0063084 A1 * 2/2019 Bunch ..... E04F 21/22
2020/0063448 A1 * 2/2020 Morrow ..... E04F 21/1877

* cited by examiner

*Primary Examiner* — Theodore V Adamos

(74) *Attorney, Agent, or Firm* — Kirton McConkie; Evan R. Witt

(57) ABSTRACT

A tile laying accessory includes a flange having opposed ends and opposed sides, a web that extends from the flange, intermediate the opposed sides, and at least one spacing formation arranged on at least one of the flange and the web. The flange and the web are configured so that edge portions of two adjacent tiles are positioned on the flange on respective sides of the web, with the web extending between the adjacent tiles. The web is configured to engage a levelling member having a bearing surface. The levelling member and the web provide relative displacement of the levelling member and the web, which results in the bearing surface of the levelling member bearing against the edge portions of adjacent tiles. The spacing formation is configured so that the adjacent tile edge portions bear against the spacing formation with the web being spaced from the adjacent tile edge portions.

5 Claims, 9 Drawing Sheets

TILE LAYING ACCESSORY

FIELD

This invention relates to a tile laying accessory.

BACKGROUND TO THE INVENTION

In International patent application number PCT/EP92/00262, published as WO 92/14012, there is described a device for laying rigid flooring modules, such as tiles. The device includes a disposable element and a wedge, preferably of a plastics material. The disposable element has a T-shaped cross-section with a "central portion" and at least two "arms" that extend from the central portion. The central portion has a hole. A "wedge" with a flat levelling surface can be inserted into the hole. In use, the disposable element is positioned with its arms under two consecutive flooring modules and immersed in adhesive for fixing the modules to a floor foundation. The central portion extends above upper faces of the modules through a gap between the modules. One edge of the hole is above the upper faces of the modules. The wedge is inserted into the hole between that edge and the upper faces of the modules with the flat levelling service in engagement with the upper faces to clamp the two modules between the wedge and the arms. The central portion includes a weakened zone or breakaway line that is intended to permit the central portion to be broken away from the remainder of the device once the adhesive has set.

There have been various improvements or developments on this device since the filing of the above international application. For example, Australian patent number 2011203224 identifies a problem with the adhesive filling the breakaway line. That may make it difficult to break the central portion or web away from the arms or flange. Also, in some cases, the adhesive might not extend over the arms or the flange (also referred to as horizontal members) such that portions of the tiles that extend over the horizontal members are not adhered to the undersurface of the tiles. This problem is approached by locating the breakaway line at or above the highest points of the horizontal member sections such that the breakaway line is not exposed to the adhesive. Furthermore, the central portion may define cutouts at the ends of the breakaway line.

In the above examples, the modules or tiles are kept separated by the central portion (or "main member" in patent number 2011203224).

The description of the devices in this background section is not an admission that such devices form relevant prior art information.

SUMMARY

According to a first aspect of the invention, there is provided a tile laying accessory that includes:

a flange having opposed ends and opposed sides;

a web that extends from the base, intermediate the opposed sides, the flange and the web being configured so that edge portions of adjacent tiles can be positioned on the flange on respective sides of the web, with the web extending between the adjacent tiles, the web being configured to engage a levelling member having a bearing surface, the levelling member and the web being configured so that relative displacement of the levelling member and the web results in the bearing surface of the levelling member bearing against the edge portions of the adjacent tiles; and at least one spacing formation arranged on at least one of the flange and the web, the, or each, spacing formation being configured so that the adjacent tile edge portions can bear against the, or each, spacing formation with the web being spaced from the adjacent tile edge portions.

At least one of the web and the flange may include a zone of weakness, such as a frangible region or one or more openings, to permit at least a portion of the accessory to be separated from a remaining portion, the zone of weakness being positioned so that the remaining portion remains below respective upper surfaces of the adjacent tile edge portions.

The, or each, spacing formation and the web may be in alignment with each other along a line that is substantially parallel to adjacent tile edges, in use. The, or each, spacing formation may have a dimension, generally orthogonal to the line, that is greater than a corresponding dimension of the web. Thus, when adjacent tiles are laid, the edge portions can bear against the, or each, spacing formation, setting up a clearance between the edge portions and the web.

The web may include two spaced stems extending from the flange, with the zone of weakness at a junction of each stem and the flange. The zone of weakness could also be positioned intermediate ends of the stems.

A bridge member may interconnect the stems such that the flange, the stems and the bridge member define an opening for receiving the levelling member in the form of a wedge. The wedge can be the wedge described in the background section of this specification.

The, or each, spacing formation may be a spacer that extends from the base, between the stems. In another embodiment, the, or each, spacing formation may be two spacers, on respective outer sides of the web. In yet another embodiment, the, or each, spacing formation may be a spacer that interconnects the two spaced stems.

In one embodiment, at least one further spacing formation may be arranged on at least one of the flange and the web. The, or each, further spacing formation may be configured so that corner portions of four adjacent tiles can be positioned on the flange with edge portions of adjacent tiles on each side of the web that are orthogonal to the edge portions bearing against the spacing formation can bear against the, or each further spacing formation. Such an arrangement is suitable for use at a junction between four adjacent tiles.

The, or each, further spacing formation may be a further spacer or section that extends from each side of the spacer that extends between the stems to form a generally cruciform arrangement.

DETAILED DESCRIPTION

Figure 1:
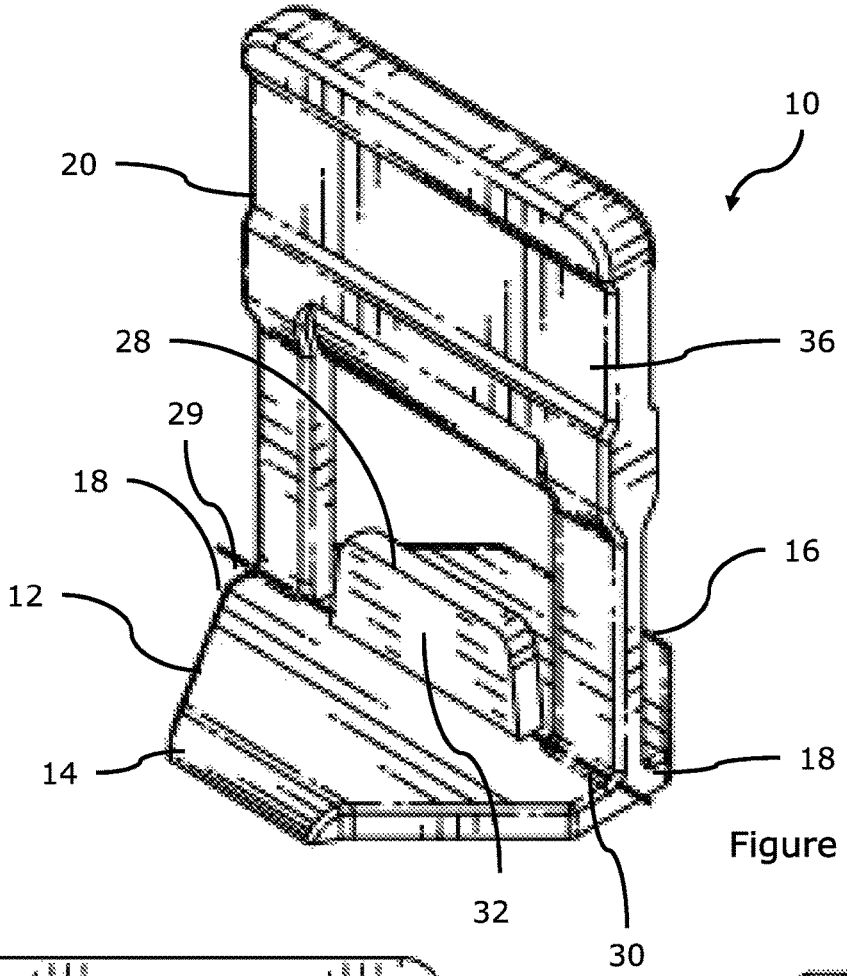
FIG. 1 shows a three-dimensional view of an embodiment of a tile laying accessory, in accordance with the invention.
Figure 2:
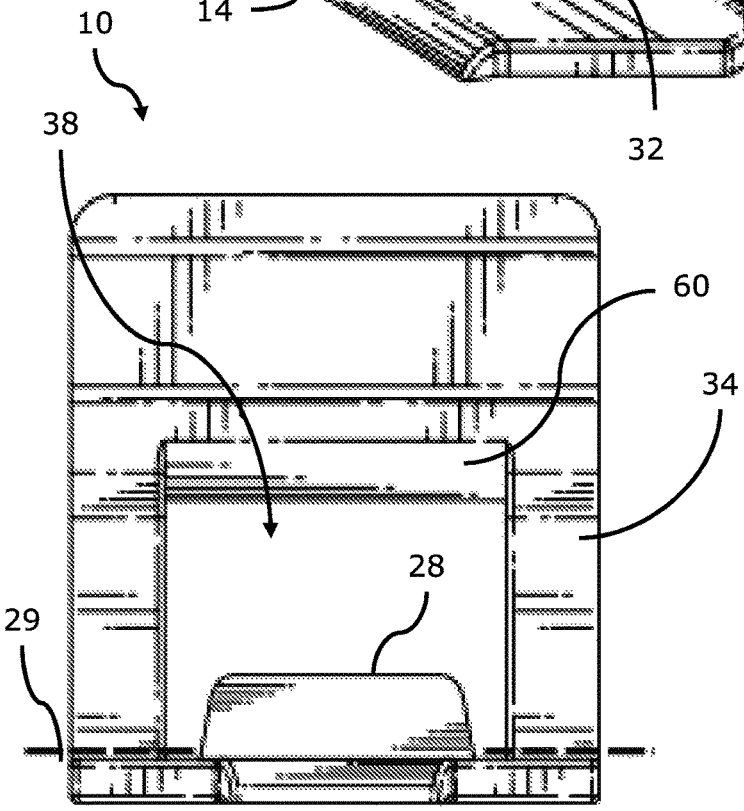
FIG. 2 shows a front view of the tile laying accessory of FIG. 1.
Figure 3:
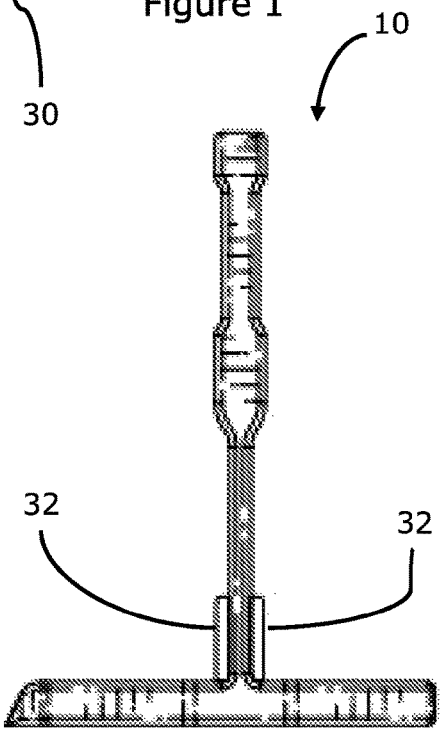
FIG. 3 shows a side view of the tile laying accessory.
Figure 4:
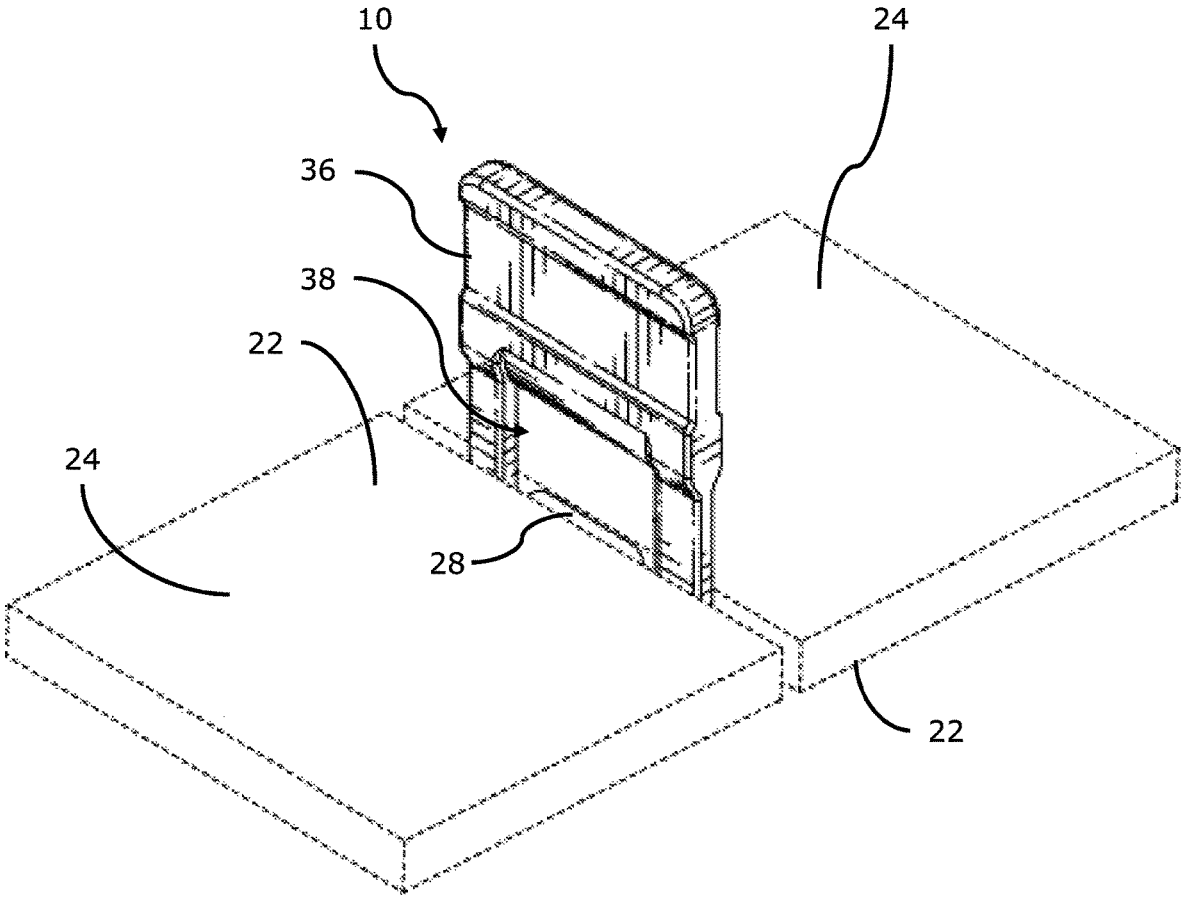
FIG. 4 shows the tile laying accessory of FIG. 1, in use.
Figure 5:
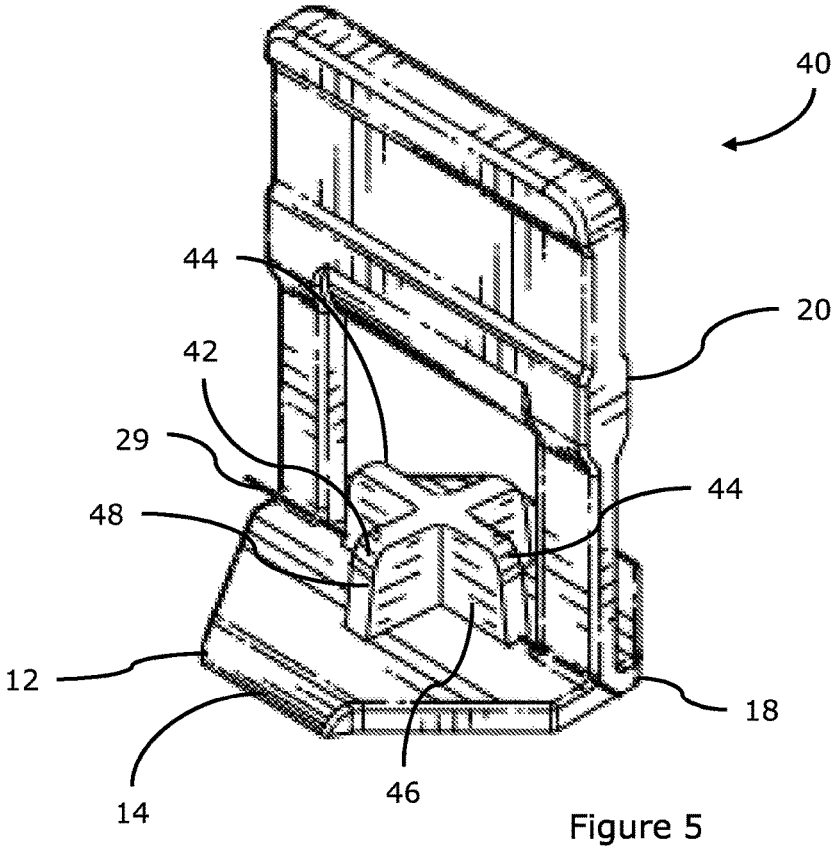
FIG. 5 shows a three-dimensional view of an embodiment of a tile laying accessory, in accordance with the invention.
Figure 6:
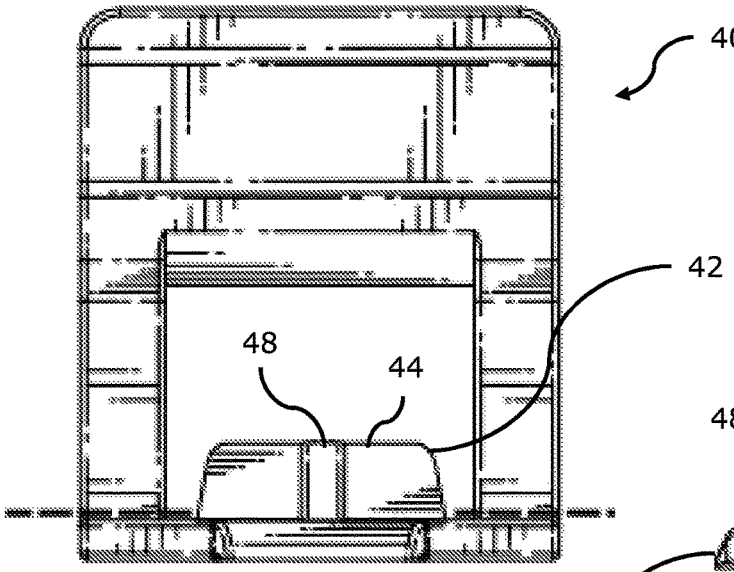
FIG. 6 shows a front view of the tile laying accessory of FIG. 5.
Figure 7:
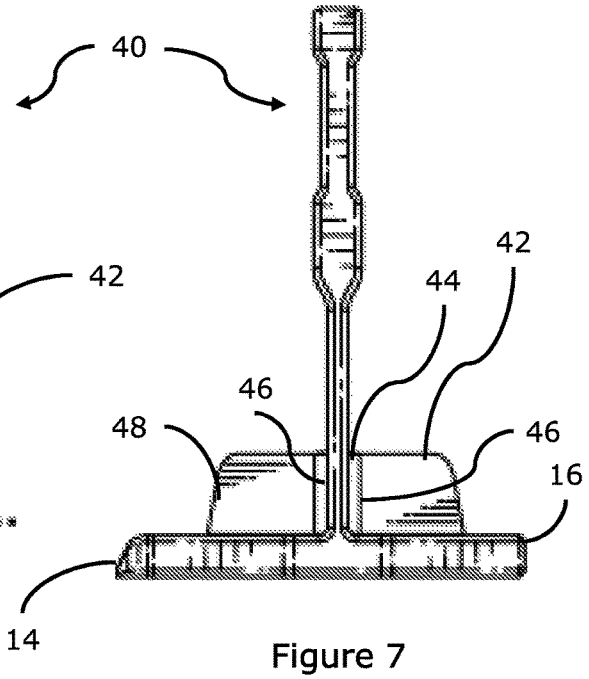
FIG. 7 shows a side view of the tile laying accessory of FIG. 5.

In FIGS. 1 to 4, reference numeral 10 generally indicates an embodiment of a tile laying accessory, in accordance with the invention. The accessory 10 is useful for aligning and levelling tiles during a laying process. It is to be understood that the accessory 10 can be used with other modular building elements. Thus, the word "tile" is to be understood as extending beyond the conventionally known narrow meaning of a rectangular, ceramic building element that is adhered to a substrate. Rather, it can extend to any building or architectural module that is required to be laid on a substrate together with other modules in a level and equally spaced manner.

The accessory 10 includes a flange 12 having opposed ends in the form of a front end 14 and a rear end 16. The flange 12 also has a pair of opposed sides 18.

A web 20 extends from the flange 12 intermediate the sides 18. The flange 12 and the web 20 are configured so that edge portions 22 (FIG. 4) of adjacent tiles 24 can be positioned on the flange 12 on respective sides of the web 20, with the web 20 extending between the adjacent tiles 24.

The web 20 is configured to engage a levelling member in the form of a wedge 26 (FIG. 12) having a bearing surface, the levelling member and the web 20 being configured so that relative displacement of the levelling member and the web 20 results in the bearing surface of the levelling member bearing against the edge portions 22 of the adjacent tiles 24.

A spacing formation in the form of a spacer 28 is arranged on the flange 20 and is configured so that the adjacent tile edge portions 22 can bear against the spacer with the web 20 being spaced from the adjacent tile edge portions.

A zone of weakness 30 is defined at a junction between the web 20 and the flange 12. The zone of weakness 30 is configured so that, when the flange 12 is secured between a substrate and the tile edge portions 22, the web 20 can be broken off the flange 12 with a suitable tool such as a hammer or simply with a kick. The zone of weakness 30 can take different forms. For example, it can be defined by a waisted portion or by appropriately positioned openings. It could also be a frangible region extending across the web 20.

The web 20 and the spacer 28 are in alignment with each other along a line 29 that is substantially parallel to adjacent tile edges, in use. The spacer has a dimension, generally orthogonal to the line, extending between the front and rear ends 14, 16, that is greater than a corresponding dimension of the web 20. Thus, when adjacent tiles 24 are laid, the edge portions 22 can bear against respective front and rear sides 32 of the spacer 28. This sets up a clearance between the edge portions 22 and the web 20. The spacer 28 has a substantially uniform thickness along the line 29 to provide a stable surface for abutment with the edge portions 22.

The web 20 includes two spaced stems 34 extending from the flange 12, with the zone of weakness 30 at a junction of each stem 34 and the flange 12. A bridge member or bridge 36 interconnects the stems 34 such that the flange 12, the stems 34 and the bridge 36 define an opening 38 for receiving the wedge 26. The stems 34 can be long enough so that the bridge 36 does not interfere with the tiles 24 that are up to 20 mm in thickness. For example, the stems 34 can suit tiles 24 of between about 14 mm and 20 mm in thickness. In that case, the spacer 28 can have a height of about 7 mm.

In this embodiment, the spacer 28 is positioned between the stems 34. Each stem 34 has a square or rectangular cross-section and the line 29 bisects the stems 34. Similarly, the spacer 28 has a rectangular cross section with the line 29 bisecting the spacer 28. The spacer 28 has a thickness, in a direction orthogonal to the line 29, that is greater than a thickness, in the same direction, of the stems 34. In one example, the spacer 28 has a thickness of 2 mm and the thickness of the stems 34 is 1.85 mm. These thicknesses can vary depending on the application and other parameters, with the proviso that the spacer 28 serves to maintain a separation of the tiles or building modules to an extent that is enough to provide a clearance between the stems 34 and the edge portions 22.

In FIGS. 5 to 8, reference numeral 40 generally indicates an embodiment of a tile laying accessory, in accordance with the invention. With reference to the preceding drawings, like reference numerals refer to like parts, unless otherwise specified.

Figure 8:
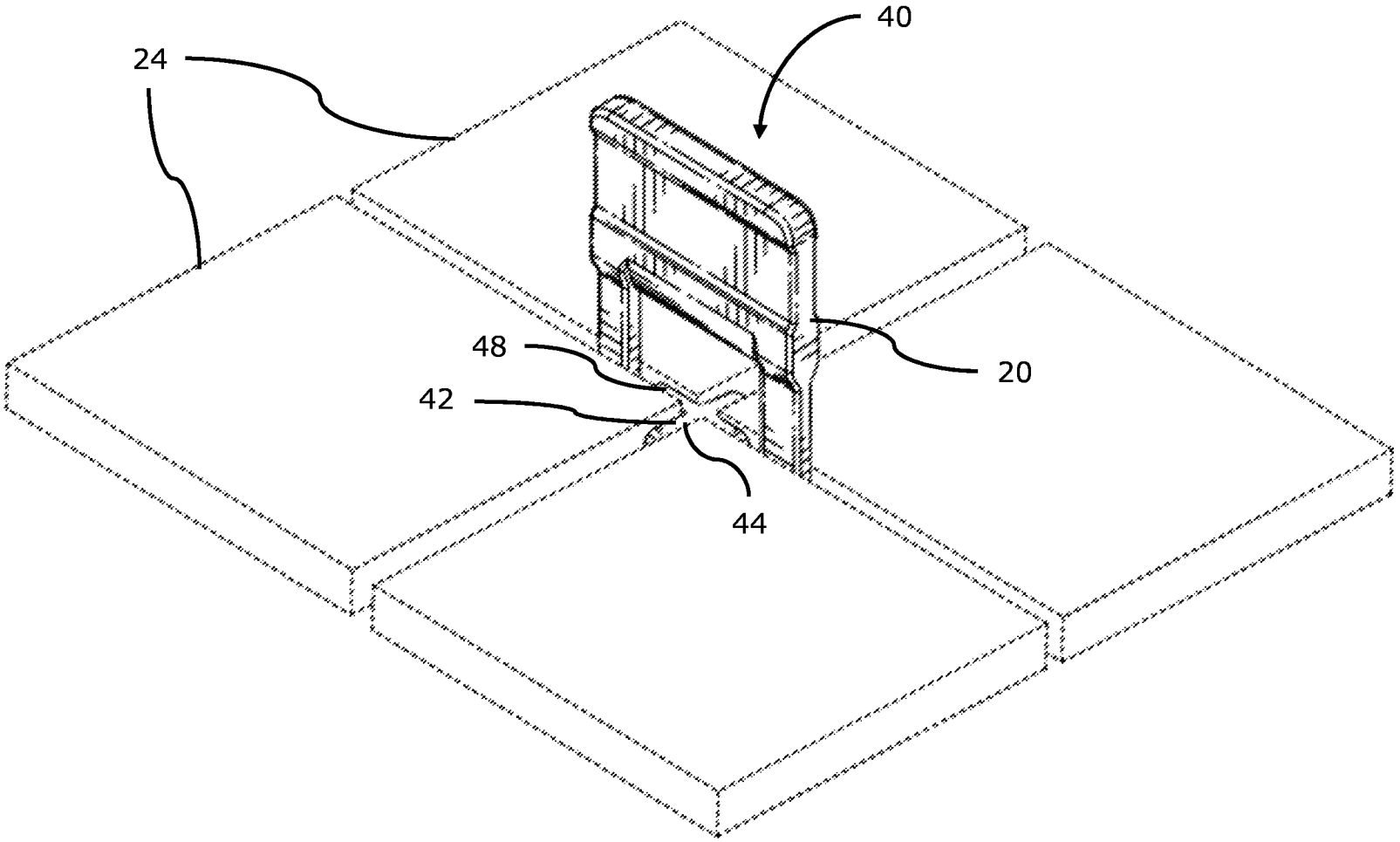
FIG. 8 shows the tile laying accessory of FIG. 5, in use.
Figure 9:
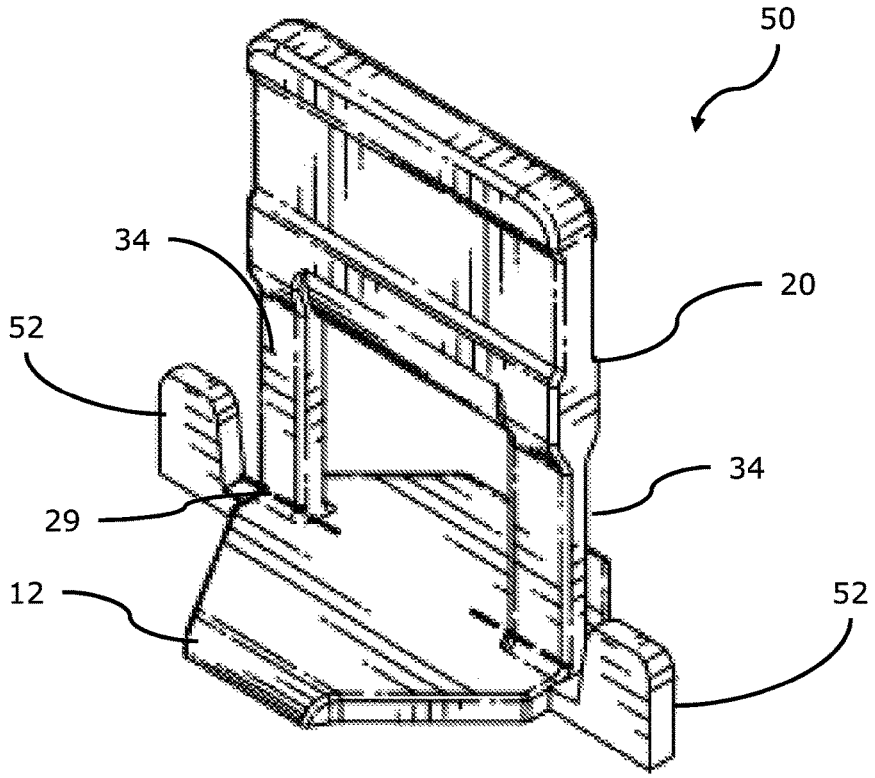
FIG. 9 shows a three-dimensional view of an embodiment of a tile laying accessory, in accordance with the invention.
Figure 10:
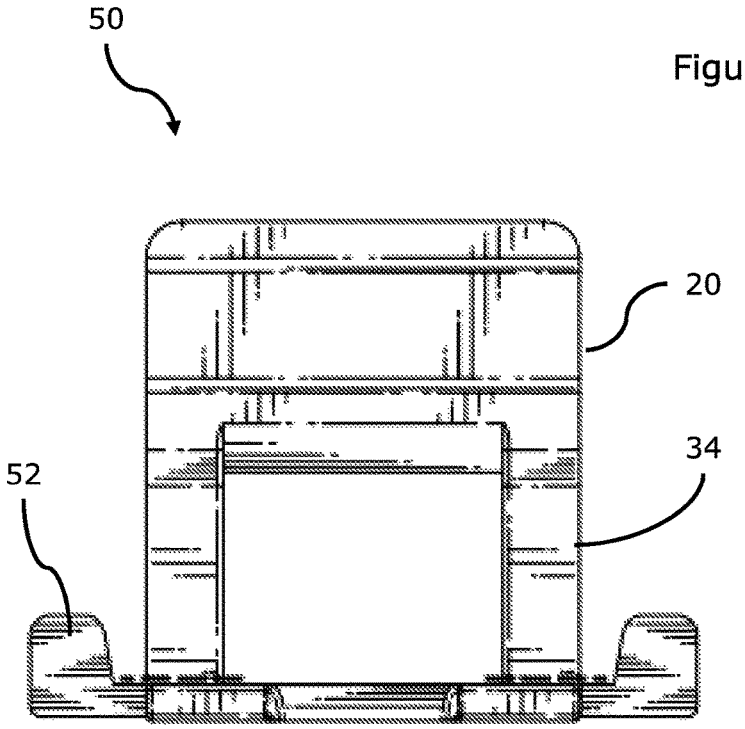
FIG. 10 shows a front view of the tile laying accessory of FIG. 9.
Figure 11:
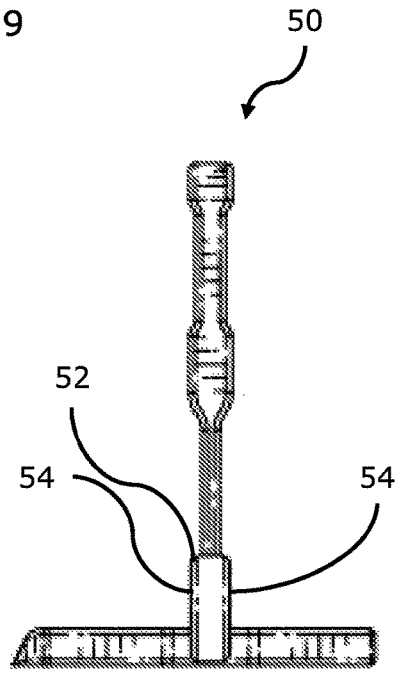
FIG. 11 shows a side view of the tile laying accessory of FIG. 9.

The accessory 40 is suitable for levelling and aligning corner portions of four adjacent tiles 24, as shown in FIG. 8.

In this embodiment, a spacer 42 extends from the flange 12 between the stems 34. The spacer 42 is generally cruciform with a first pair of aligned sections 44 in alignment with the stems 34 and positioned on the line 29. The aligned sections 44 have a dimension, generally orthogonal to the line 29, extending between the front and rear ends 14, 16 that is greater than a corresponding dimension of the web 20. Thus, when adjacent pairs of tiles 24 are laid on respective front and rear sides of the web 20, the edge portions 22 of those tiles can bear against respective front and rear sides 46 of the sections 44. This sets up a clearance between the edge portions 22 and the web 20. The sections 44 have a substantially uniform thickness along the line 29 to provide a stable surface for abutment with the edge portions 22.

The spacer 42 is positioned between the stems 34 and can have a height that is the same as the height of the spacer 28. The sections 44 each have a square or rectangular cross-section and the line 29 bisects the stems 34. The sections 44 have a thickness, in a direction orthogonal to the line 29, that is greater than a thickness, in the same direction, of the stems 34. In one example, the sections 44 have a thickness of 2 mm and the thickness of the stems 34 is 1.85 mm. These thicknesses can vary depending on the application and other parameters, with the proviso that the sections 44 serve to maintain a separation of the tiles or building modules to an extent that is enough to provide a clearance between the stems 34 and the edge portions 22.

The spacer 42 has a second pair of aligned sections 48 that are orthogonal to the sections 44 to form a generally cruciform shape. It will readily be appreciated that the sections 44, 48 need not necessarily form a single structure. The sections 48 could be in the form of two discrete further spacing formations or sections on each side of the spacer 28, for example. In another example, there could be two discrete spacing formations or sections 44 and the sections 48 could be a single structure. In yet another example, the sections 44, 48 could all be spacing formations that are discrete from each other.

The sections 48 have a substantially uniform thickness that is equivalent to that of the sections 44 so that the sections 48 can serve to ensure that a spacing between two pairs of aligned tiles 24 is consistent.

In FIGS. 9 to 12, reference numeral 50 generally indicates an embodiment of a tile laying accessory, in accordance with the invention. With reference to the preceding drawings, like reference numerals refer to like parts, unless otherwise specified.

In this embodiment, two spacers 52 are mounted on the respective sides 18 of the flange 12. Each of the spacers 52 has a dimension, generally orthogonal to the line 29, extending between the front and rear ends 14, 16, that is greater than a corresponding dimension of the web 20. Thus, when adjacent tiles 24 are laid, the edge portions 22 can bear against respective front and rear sides 54 of the spacers 52. This sets up a clearance between the edge portions 22 and the web 20. The spacers 52 each have a substantially uniform thickness along the line 29 to provide a stable surface for abutment with the edge portions 22.

The spacers 52 are positioned so that the line 29 bisects the spacers. Each spacer 52 has a square or rectangular cross-section with a thickness, in a direction orthogonal to the line 29, that is greater than a thickness, in the same direction, of the stems 34. In one example, the spacers 52 have a thickness of 2 mm. This thickness can vary depending on the application and other parameters, with the proviso that the spacers 52 serve to maintain a separation of the tiles or building modules to an extent that is enough to provide a clearance between the stems 34 and the edge portions 22.

Figure 12:
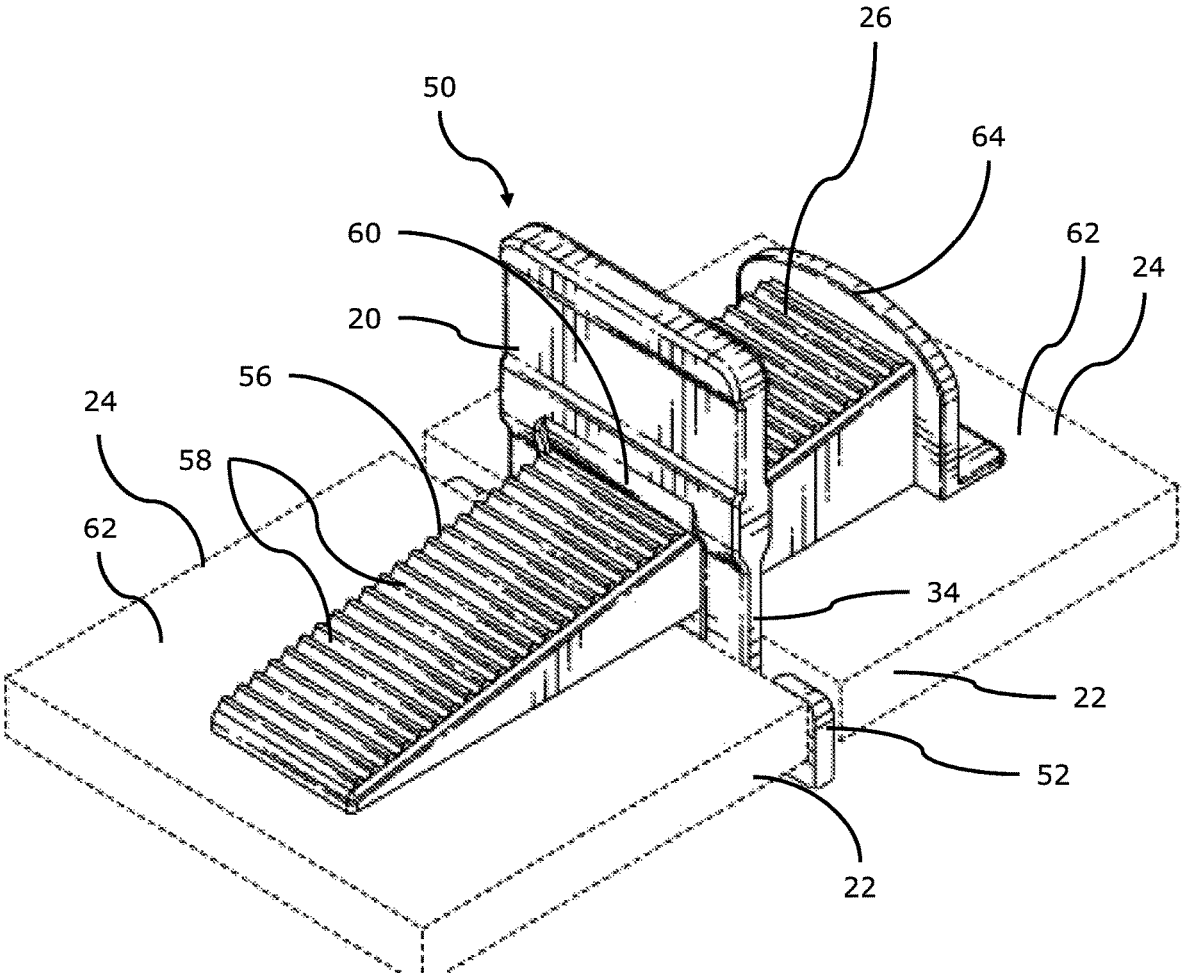
FIG. 12 shows the tile laying accessory of FIG. 9, in use.
Figure 13:
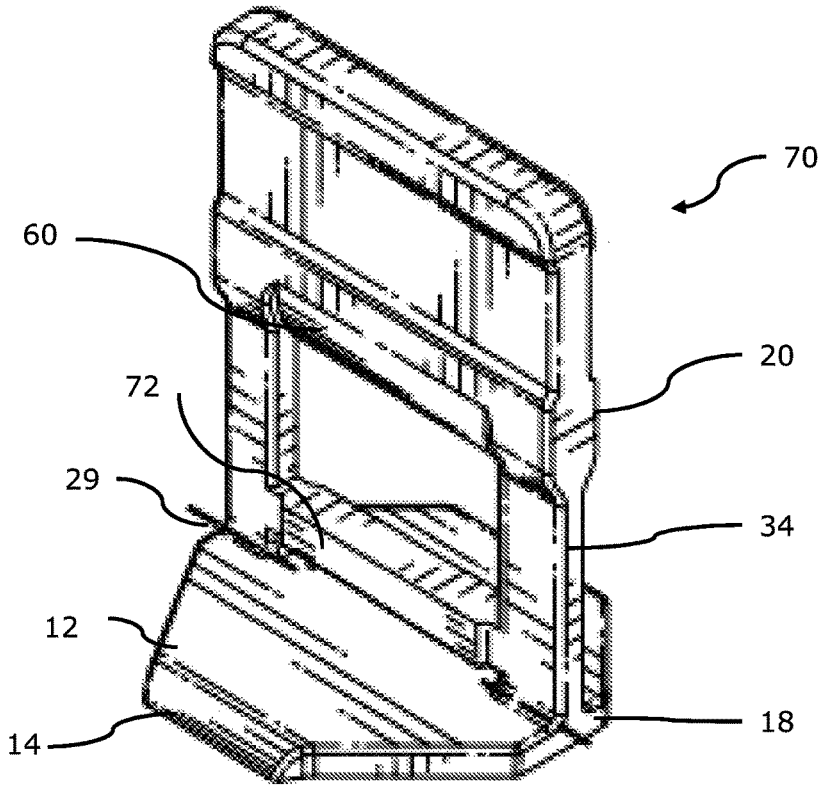
FIG. 13 shows a three-dimensional view of an embodiment of a tile laying accessory, in accordance with the invention.
Figure 14:
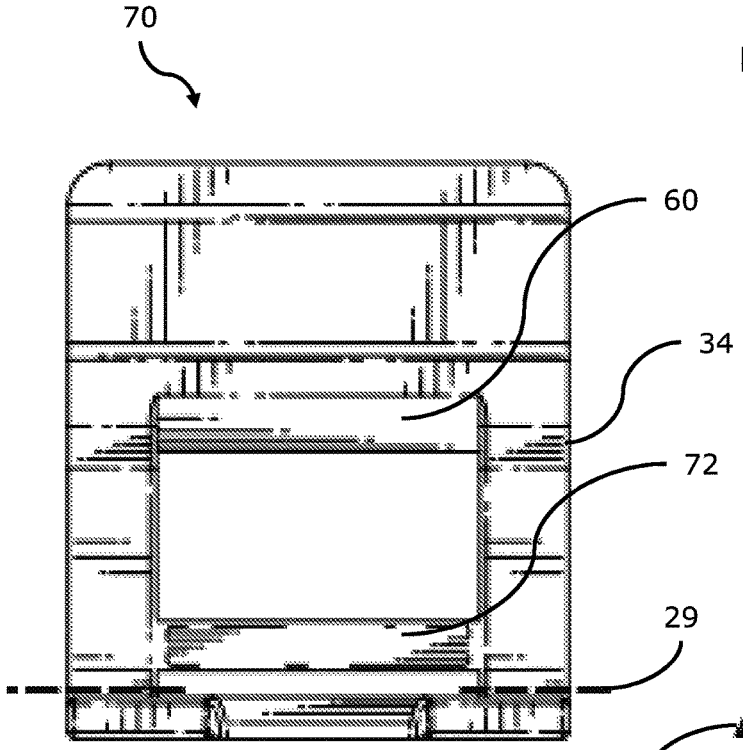
FIG. 14 shows a front view of the tile laying accessory of FIG. 13.
Figure 15:
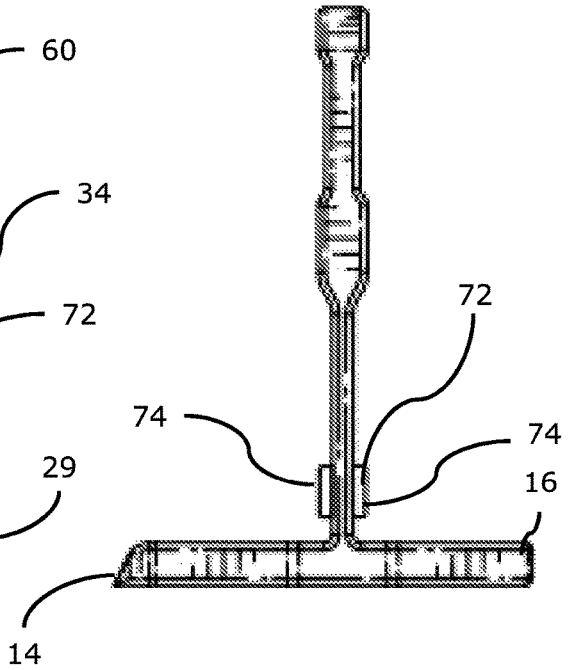
FIG. 15 shows a side view of the tile laying accessory of FIG. 13.
Figure 16:
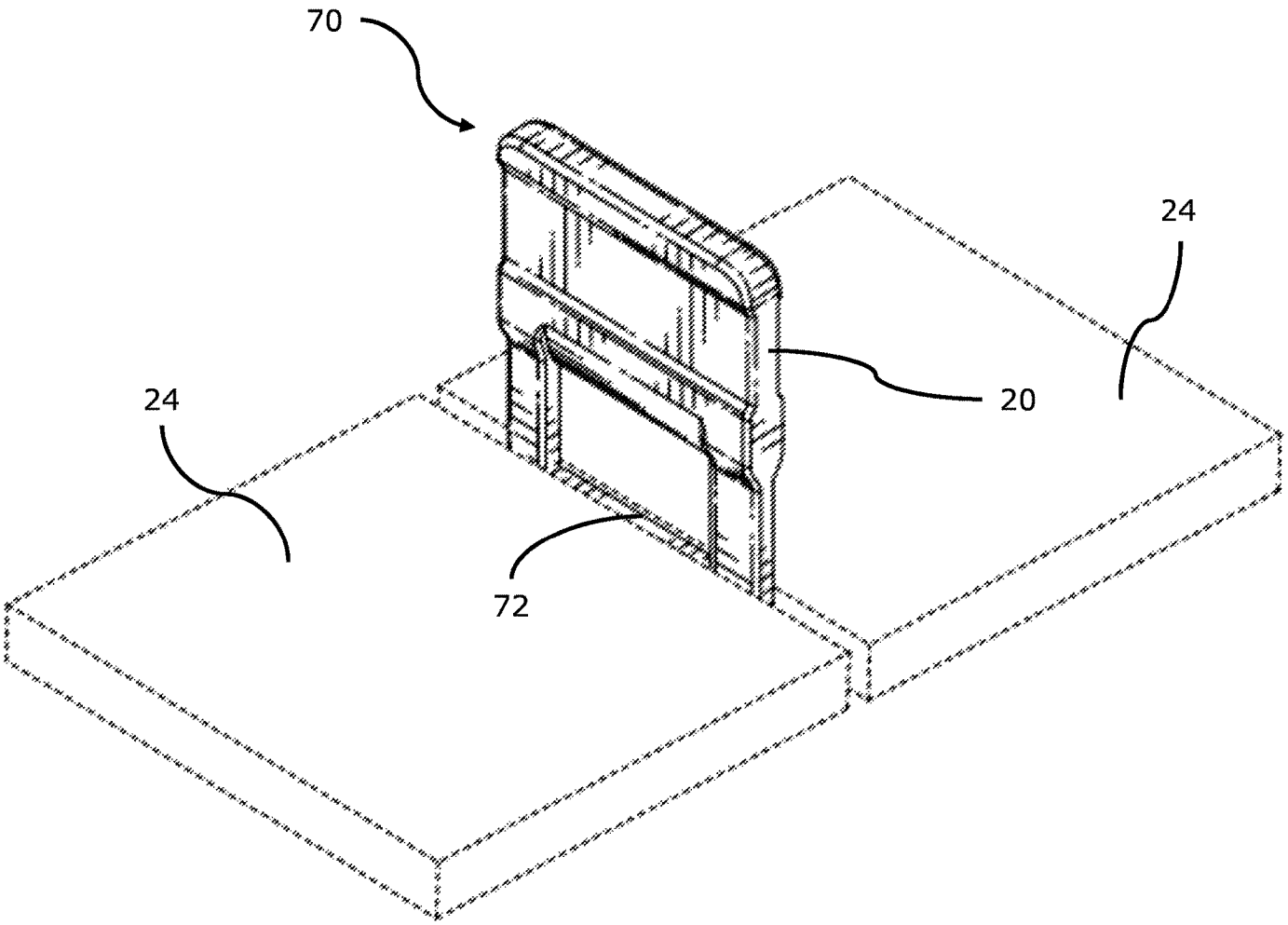
FIG. 16 shows the tile laying accessory of FIG. 13, in use.

The wedge 26 is shown in some detail in FIG. 12. The wedge 26 has a serrated or toothed proximal surface 56, defining a series of teeth, ridges or serrations 58 that extend transversely such that they can be aligned with a distal, internal edge 60 of the bridge 36. The distal edge 60 of the bridge 36 and the serrations 58 can be configured so that the surface 56 can clip into engagement with the bridge 56 as the wedge 26 is driven into an opening defined by the bridge 36, the stems 34 and surfaces 62 of the tiles 24.

A manipulating formation 64 is arranged on a major end 66 of the wedge 26 to facilitate manipulation of the wedge 26.

In FIGS. 13 to 16, reference numeral 70 generally indicates an embodiment of a tile laying accessory, in accordance with the invention. With reference to the preceding drawings, like reference numerals refer to like parts, unless otherwise specified.

The accessory 70 includes a spacer 72 that interconnects the stems 34. The spacer 72 is positioned so that it is located between the edge portions 22 of the adjacent tiles, in use.

The spacer 72 has a dimension, generally orthogonal to the line 29, extending between the front and rear ends 14, 16, that is greater than a corresponding dimension of the web 20. Thus, when adjacent tiles 24 are laid, the edge portions 22 can bear against respective front and rear sides 74 of the spacer 72. This sets up a clearance between the edge portions 22 and the web 20. The spacer 72 has a substantially uniform thickness along the line 29 to provide a stable surface for abutment with the edge portions 22.

In one example, the spacer 72 has a thickness of 2 mm. This thickness can vary depending on the application and other parameters, with the proviso that the spacer 28 serves to maintain a separation of the tiles or building modules to an extent that is enough to provide a clearance between the stems 34 and the edge portions 22.

When tiles are laid on walls, as opposed to floor surfacing, the tiles can tend to move towards each other under gravity. It has been found that tilers are reluctant to use the devices described in the background to the specification because the web can get stuck between the end portions of the tiles. Consequently, attempts to break off the web portions can result in damage to the tiles.

This situation can be exacerbated when relatively heavy tiles, such as granite and other stone tiles, are used. Such tiles can clamp the webs of previous devices to such an extent that removal of the webs is difficult if not impossible.

In the above embodiments, the spacers serve to maintain the edge portions spaced apart to an extent that provides a level of clearance between the web 20 and the edge portions 22. As a result, the edge portions do not interfere with the process of detaching or breaking off the webs 20 from the flanges 12 after laying wall tiles.

In use, the edge portion of a lower tile is positioned on the flange, on one side of the web and brought into abutment with the spacer. The edge portion of an upper tile is then positioned on the flange, on an opposite side of the web, and also brought into abutment with the spacer. This determines the gap between the tiles. The levelling device or wedge is then engaged with the web to carry out the levelling function. One the adhesive or other material has set or dried, the stems can readily be detached from the flange, since they are not being gripped by the edge portions.

In the above embodiments there is described a device that can be used for levelling and spacing wall tiles at the same time. As mentioned above, tilers have avoided using previous levelling devices on walls because of the clamping effect described above. The embodiments described herein avoid problems associated with that clamping effect because it is the spacers that are clamped and not the webs.

The accessory 40 is useful for use with adjacent corners of tiles. Currently, tilers use cruciform spacers at the corners. However, it is still necessary to use a separate levelling device. The accessory 40 provides the ability to achieve both spacing and levelling at the corners with the positioning of a single device. This is significantly quicker than a process that involves the steps of locating the cruciform spacers and levelling with a different tool.

In this case, the corner portions of four tiles are positioned on the flange with facing end portions of two tiles on one side of the web abutting the spacer and facing end portions of two tiles on the other side of the web abutting the spacer. The facing end portions of the two tiles on opposite sides of the web are also brought into abutment with the spacer. As before, once the adhesive or other material has set, the stems can readily be detached from the flange because they are not being gripped by the edge portions.

Figure 17:
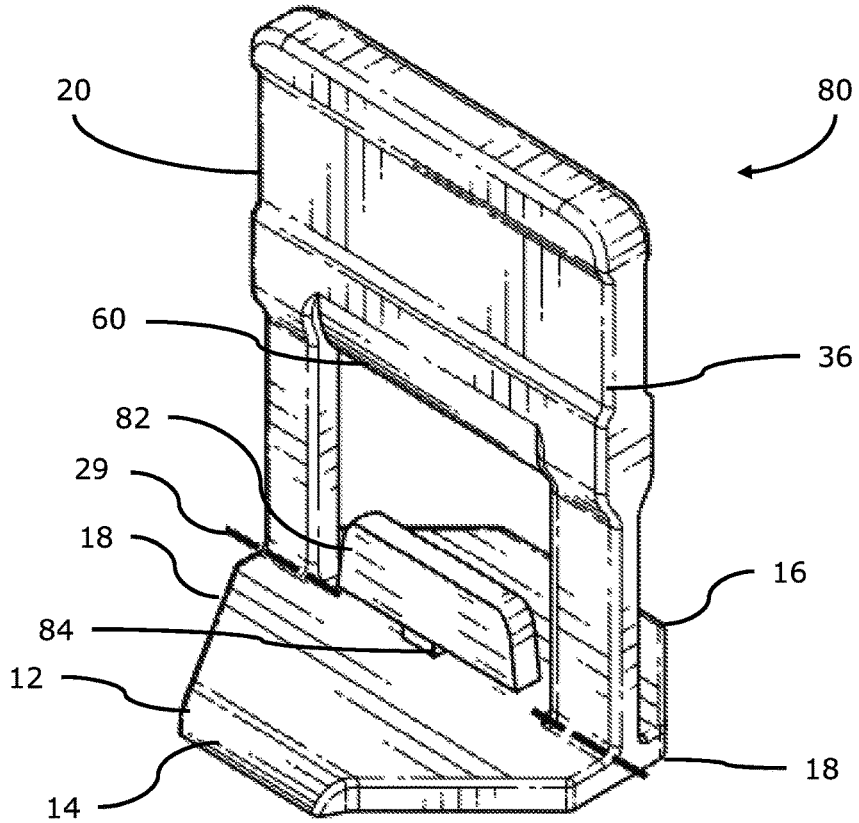
FIG. 17 shows a three-dimensional view of a further embodiment of a tile laying accessory, in accordance with the invention.
Figure 18:
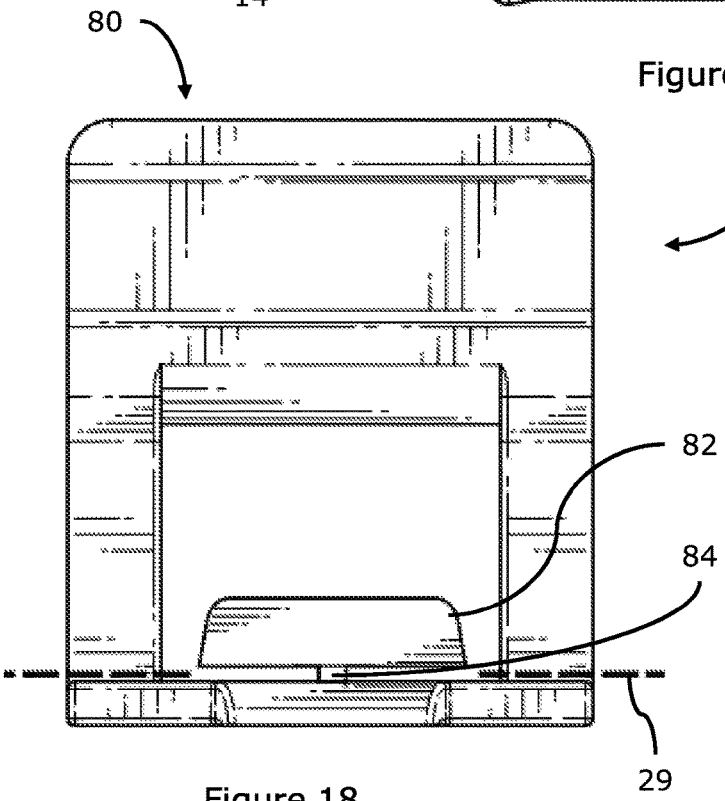
FIG. 18 shows a front view of the tile laying accessory of FIG. 17.
Figure 19:
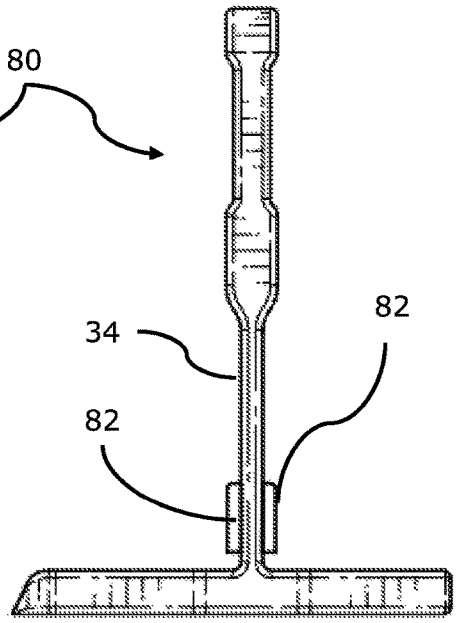
FIG. 19 shows a side view of the tile laying accessory of FIG. 17.

In FIGS. 17 to 19, reference numeral 80 generally indicates a further embodiment of a tile laying accessory, in accordance with the invention. With reference to the preceding drawings, like reference numerals refer to like parts, unless otherwise specified.

In some cases, it is necessary that the tiles or building elements 24 be permitted to expand, to some degree, relative to each other as a result of changing temperatures and other factors. It will be appreciated that, in the various embodiments described above, the spacer will interfere with such expansion. Thus, the tile laying accessory 80 is configured to permit the spacer to be removed together with the stems 34.

To that end, the tile laying accessory 80 has a spacer 82 that is connected to the flange 12 with a connector 84 that is configured to permit the spacer 82 to be broken away from the flange 12 such that neither the spacer 82 nor the connector 84 will obstruct movement of the tiles 24 as a result of expansion.

For example, as seen in the drawings, the connector 84 can be in the form of a tab that interconnects the spacer 82 and the flange 12. The tab is configured to break away from the flange 12 at a junction between the flanges 12 and the tab 84.

Thus, in use, once the tiles or building elements 24 are set, a suitable tool can be used to detach the spacer 22 and the connector 84 to leave an area which does not obstruct the expansion of the tiles.

It will be appreciated that the spacers 28, 52 of the accessories 10, 50 can also include similar connectors so that they can be broken off to accommodate expansion of the tiles. This will not be necessary with the accessory 70 since the spacer 72 is connected to the stems 34 and so will be removed together with those stems 34.

The appended claims are to be considered as incorporated into the above description.

The use of common reference numerals is for convenience only and is not to be regarded as limiting. Furthermore, characteristics or components of the various embodiments described herein can be interchanged, where practical or reasonable to do so.

It is to be understood that the terminology employed above is for description and should not be regarded as limiting. The described embodiments are intended to be illustrative of the invention, without limiting the scope thereof. The invention is capable of being practised with various modifications and additions as will readily occur to those skilled in the art.

When any number or range is described herein, unless clearly stated otherwise, that number or range is approximate. Recitation of ranges of values herein are intended to serve as a shorthand method of referring individually to each separate value falling within the range, unless otherwise indicated herein, and each separate value and each separate subrange defined by such separate values is incorporated into the specification as if it were individually recited herein.

Words indicating direction or orientation, such as "front", "rear", "back", etc, are used for convenience. The inventor(s) envisages that various embodiments can be used in a non-operative configuration, such as when presented for sale. Thus, such words are to be regarded as illustrative in nature, and not as restrictive.

The invention claimed is:

1. A tile laying accessory comprising:

a flange having opposed ends and opposed sides; and a web that extends from the flange, intermediate the opposed sides, the flange and the web being configured so that edge portions of two adjacent tiles can be positioned on the flange on respective sides of the web, with the web extending between the adjacent tiles, the web being configured to engage a levelling member having a bearing surface, the levelling member and the web being configured so that relative displacement of the levelling member and the web results in the bearing surface of the levelling member bearing against the edge portions of the adjacent tiles; and two spacing formations arranged on the flange, the spacing formations being configured so that the adjacent tile edge portions can bear against the spacing formations with the web being spaced from the adjacent tile edge portions, wherein at least one of the web and the flange includes a zone of weakness to permit at least a portion of the accessory to be separated from a remaining portion, the zone of weakness being positioned so that the remaining portion remains below respective upper surfaces of the adjacent tile edge portions, wherein the web includes two spaced stems extending from the flange, with the zone of weakness at a junction of each stem and the flange wherein the spacing formations and the web are in alignment with each other along a line that is substantially parallel to adjacent tile edges, in use, and the spacing formations have a dimension, generally orthogonal to the line, that is greater than a corresponding dimension of the web, such that, when adjacent tiles are laid, the edge portions can bear against the spacing formations, setting up a clearance between the edge portions and the web in which the spacing formations extend from the flange, on respective outer sides of the web.

2. The tile laying accessory as claimed in claim 1, in which a bridge member interconnects the stems such that the flange, the stems and the bridge member define an opening for receiving the levelling member in the form of a wedge.

3. The tile laying accessory as claimed in claim 1, which includes at least one further spacing formation arranged on the flange, the, or each, further spacing formation being configured so that corner portions of four adjacent tiles can be positioned on the flange with edge portions of adjacent tiles on respective sides of the web that are orthogonal to the edge portions bearing against the spacing formation can bear against the, or each further spacing formation.

4. A tile laying accessory comprising:

a flange having opposed ends and opposed sides; and a web that extends from the flange, intermediate the opposed sides, the flange and the web being configured so that edge portions of two adjacent tiles can be positioned on the flange on respective sides of the web, with the web extending between the adjacent tiles, the web being configured to engage a levelling member having a bearing surface, the levelling member and the web being configured so that relative displacement of the levelling member and the web results in the bearing surface of the levelling member bearing against the edge portions of the adjacent tiles, wherein the web includes two spaced stems extending from the flange; and a spacing formation interconnecting the two spaced stems and being suspended by the two spaced stems, the spacing formation being configured so that the adjacent tile edge portions can bear against the spacing formation with the web being spaced from the adjacent tile edge portions, wherein at least one of the web and the flange includes a zone of weakness to permit at least a portion of the accessory to be separated from a remaining portion, the zone of weakness being positioned so that the remaining portion remains below respective upper surfaces of the adjacent tile edge portions, with the zone of weakness at a junction of each stem and the flange wherein the spacing formation and the web are in alignment with each other along a line that is substantially parallel to adjacent tile edges, in use, and the spacing formation has a dimension, generally orthogonal to the line, that is greater than a corresponding dimension of the web, such that, when adjacent tiles are laid, the edge portions can bear against the, or each, spacing formation, setting up a clearance between the edge portions and the web.

5. The tile laying accessory as claimed in claim 4, in which a bridge member interconnects the stems such that the flange, the stems and the bridge member define an opening for receiving the levelling member in the form of a wedge.

* * * * *